US008905141B2

(12) United States Patent
Gustafson

(10) Patent No.: US 8,905,141 B2
(45) Date of Patent: Dec. 9, 2014

(54) SUBSEA OPERATING VALVE CONNECTABLE TO LOW PRESSURE RECIPIENT

(75) Inventor: Ryan Cheaney Gustafson, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 50 days.

(21) Appl. No.: 13/323,998

(22) Filed: Dec. 13, 2011

(65) Prior Publication Data

US 2013/0146303 A1 Jun. 13, 2013

(51) Int. Cl.
*E21B 19/00* (2006.01)
*E21B 34/04* (2006.01)

(52) U.S. Cl.
USPC ..... 166/363; 166/364; 166/85.4; 166/335; 251/1.1; 251/1.3; 251/241

(58) Field of Classification Search
CPC ... E21B 33/0355; E21B 33/064; E21B 34/04; F15B 21/006; F15B 1/24; F15B 2201/31; F16K 31/1221
USPC ..... 166/335, 363–364, 85.4; 137/625.66, 137/236.1; 251/241, 1.1–1.3
See application file for complete search history.

(56) References Cited

U.S. PATENT DOCUMENTS 3,987,708 A * 10/1976 Uhrich ..... 92/134
4,311,297 A 1/1982 Barrington
5,771,931 A * 6/1998 Watson ..... 137/625.66
5,778,918 A * 7/1998 McLelland ..... 137/15.02
5,901,749 A * 5/1999 Watson ..... 137/625.66
6,125,874 A 10/2000 Holliday
6,609,533 B2 * 8/2003 Sundararajan ..... 137/15.19
2007/0240882 A1 10/2007 Leonardi et al.
2008/0185046 A1 8/2008 Springett et al.
2008/0267786 A1 10/2008 Springett et al.
2010/0155071 A1 6/2010 Gustafson
2010/0155072 A1 6/2010 Gustafson
2010/0206389 A1 * 8/2010 Kennedy et al. ..... 137/14
2011/0284236 A1 * 11/2011 Baugh ..... 166/363

OTHER PUBLICATIONS

EP Search Report and Opinion dated Feb. 15, 2013 from corresponding EP Application No. 12194960.6.

* cited by examiner

*Primary Examiner* — James G Sayre
(74) *Attorney, Agent, or Firm* — Bracewell & Giuliani LLP

(57) ABSTRACT

A valve useable in an undersea apparatus for generating a force for closing a blowout preventer (BOP) based on a pressure difference between a low pressure recipient and ambient pressure, an apparatus including the valve and related methods are provided. The valve includes a valve body enclosing a chamber with an input port selectively connectable to an output port, and a chamber separating assembly configured to separate the chamber from a region of different pressure. The assembly includes (1) a backup plate having a first portion of a first diameter towards the chamber and a second portion of a second diameter larger than the first diameter, towards the region, and (2) an upper seat located between the first portion of the backup plate and the valve body.

12 Claims, 11 Drawing Sheets

SUBSEA OPERATING VALVE CONNECTABLE TO LOW PRESSURE RECIPIENT

BACKGROUND

1. Technical Field

Embodiments of the subject matter disclosed herein generally relate to a valve useable undersea and connected to a low pressure recipient and related methods, more particularly, to a valve useable in an apparatus for operating a deep-sea blowup preventer (BOP) by generating a force due to a pressure difference between the hydrostatic pressure and a substantially lower pressure.

2. Discussion of the Background

During the past years, with the increase in price of fossil fuels, the interest in developing offshore drilling has dramatically increased, since offshore locations appear to hold vast amounts fossil fuel.

A typical offshore drilling system 10 is illustrated in FIG. 1. The system 10 may include a vessel 12 having a reel 14 (e.g., a Mux Reel) that supplies power and/or communication cords 16 to a controller 18. Some systems have hose reels to transmit fluid under pressure or hard pipe (rigid conduit) to transmit the fluid under pressure or both. Other systems may have a hose with communication or lines (pilot) to supply and operate functions subsea. However, a common feature of these systems is their limited operation depth. The controller 18 is disposed undersea, close to or on the seabed 20. In this context, it is noted that the elements illustrated in FIG. 1 are not drawn to scale and no dimensions should be inferred from FIG. 1.

A wellhead 22 covers a subsea well 23 and a drill line 24 enters the subsea well 23. At the end of the drill line 24 may be a drill (not shown). Various mechanisms, also not shown, may be employed to transmit rotation via the drill line 24 to the drill in order to extend the subsea well deeper in the formation under the seabed.

During normal operation of the system 10, unexpected high pressure flow of gas, oil or other well fluids (the high pressure exceeding the pressure of drilling fluid in the drill line 24) may emerge from the formation into the well. This kind of unexpected event (sometimes referred to as a "kick" or a "blowout") could damage the well and/or the equipment used for drilling.

In order to prevent the damaging effect of this kind of events, a pressure controlling device, for example, a blowout preventer (BOP), is usually installed on top of the well 23. The BOP is conventionally implemented as a valve closing to prevent the release of the high pressure fluids emerging from the well either in the annular space between a casing and a drill line 24 or in the open hole (i.e., hole with no drill pipe) during drilling or exploitation operations, respectively. The controller 18 controls a system of valves (not shown) in order to provide the force necessary for opening and closing the BOPs 26 and 28.

Traditionally, the force necessary to operate the BOPs is generated due to a pressure difference between the hydraulic pressure and a pressurized hydraulic fluid. The hydraulic fluid used to generate this force is commonly pressurized by equipment on the surface. The pressurized fluid is stored in an accumulator (e.g., 30 in FIG. 1) that is lowered subsea, close to the location of the BOPs, after being charged. The accumulator 30 may include plural containers (canisters) that store the hydraulic fluid under pressure to provide the necessary pressure to operate (close and open) the BOPs. The high pressure hydraulic fluid may be selectively provided via the pipe 32. The generated force is transmitted to BOPs 26 and 28.

A conventional apparatus 40 for generating a force used to operate the BOPs is illustrated in FIG. 2. The accumulator 30 is connected via valve 34 to a cylinder 36. The cylinder 36 includes a piston (not shown) that moves when a pressure difference occurs between the volumes separated by the piston, thereby generating a force used to operate a BOP 27 (which is one of the BOPs 26 and 28). The force is generated due to a pressure difference occurring in the cylinder 36 when the controller 18 makes the valve 34 to open a fluid communication from the accumulator 30 to the cylinder 36.

As understood by those of ordinary skill in the art, in deep-sea drilling, in order to provide hydraulic fluid having a pressure larger than the hydrostatic pressure generated due to the seawater at the depth of operation of the BOPs (e.g., ~240 atm at 2500 m depth), the accumulator 30 is initially charged at the surface. Typically the accumulators are charged with nitrogen. As the required pressure increases with the operating depth, the efficiency of storing the hydraulic fluid (e.g., nitrogen) useable deep-sea decreases, which adds additional cost and weight because more accumulators are then required to perform the same operation as on the surface. For example, an accumulator having a 60-liter (L) capacity and a useable volume of 24 L on the surface has a usable volume less than 4 L at 3000 m of water depth. Therefore, using accumulators to store high-pressure hydraulic fluids to operate a BOP makes the operation of the offshore rig expensive, and requires the manipulation of large parts. In other words, providing hydraulic fluid having a pressure larger than the hydraulic pressure deep undersea becomes prohibitively expensive. The equipment for charging, deploying and maintaining the accumulators is bulky, as the size of canisters that are part of the accumulator 30 increases. The range of operation of the BOPs is limited by the initial pressure difference between the charge pressure and the hydrostatic pressure at the depth of operation (i.e., deep-sea). With increasing depth (i.e., the distance from the sea surface to the seabed), storing high pressure hydraulic fluid in accumulators becomes less efficient, while the hydrostatic pressure increases, making it necessary to increase the size of the accumulators (e.g., it may become necessary to use 16 320-L bottles of nitrogen).

As disclosed in U.S. patent application Ser. No. 12/338,652 filed on Dec. 18, 2008, entitled "Subsea Force Generating Device and Method" to R. Gustafson, the entire disclosure of which is incorporated herein, an apparatus 50 as illustrated in FIG. 3, generates a subsea force F based on a pressure difference between the hydrostatic pressure and a pressure lower than the hydrostatic pressure.

The apparatus 50 includes an enclosure 52 having inside a piston 54 configured to move along thereof. The piston 54 divides the enclosure 52 into a chamber 56, called the closing chamber, and a chamber 58, called opening chamber, as shown in FIG. 3. A pressure difference between the opening chamber 58 and the closing chamber 56 yields an actuation force moving the piston and transmitted, for example, to a ram block (not shown) of the BOP via a rod 57.

When the BOP is not actuated (i.e., closed or opened), the pressure in both chambers 56 and 58 may be the same, e.g., the hydrostatic (ambient) pressure. Having fluid at ambient pressure ($P_{amb}$) in both chambers 56 and 58 may be achieved by allowing the sea water to freely enter these chambers via corresponding valves (not shown). Thus, when there is no pressure difference between the chambers 56 and 58 on opposite sides of the piston 54, the piston 54 is at rest and no force F is generated.

When a force becomes necessary (e.g., to close the BOP when and unexpected kick event occurs), a pressure imbalance may be created between the chambers 56 and 58, for example, by allowing a fluid communication between the opening chamber 58 and a low pressure recipient 60 via a valve 62. The pressure $P_r$ inside the low pressure recipient 60 may be as low as 1 atm. The valve 62 may be switched between allowing or not the fluid communication between the opening chamber 58 and the low pressure recipient 60, by a controller connected to the valve via a line 63. While a valve (not shown) allowing sea water to enter the opening chamber 58 is closed before the fluid communication between the opening chamber 58 and the low pressure recipient 60 is established, the closing chamber 56 may continue to receive sea water at hydrostatic (ambient) pressure via a pipe 64. Thus, as the piston 54 moves towards right in FIG. 3, the volume of the closing chamber 56 increases but due to additional sea water the pressure remains the same, i.e., the hydrostatic pressure at the operating depth. After the fluid communication between the opening chamber 58 and the low pressure recipient 60 is established, the pressure in the opening chamber 58 decreases towards the low pressure $P_r$, while seawater from the opening chamber 58 may enter the low pressure recipient 60, until the pressures in the opening chamber 58 and the low pressure recipient 60 become equal.

Although the arrangement shown in FIG. 3 and described in patent application Ser. No. 12/338,652, to R. Gustafson discloses the manner of generating the undersea force without the use of the accumulators, in one embodiment discussed therein, the accumulators still may be used to supply a supplemental pressure to the closing chamber 56.

Thus, a pressure difference between the closing chamber 56 and the opening chamber 58 triggers the movement of the piston 54 to the right in FIG. 3, generating the force F. However, because the seawater from the opening chamber 58 is released into the low pressure recipient 60, the low pressure recipient 60 cannot again supply the same low pressure unless a mechanism is implemented to empty the low pressure recipient 60 of the received sea water. In other words, the seawater that partially occupies the low pressure recipient 60 after valve 62 has been opened, has to be removed and the gas at the low pressure that existed in the low pressure recipient 60 prior to opening the valve 62 has to be restored, for reusing the low pressure recipient 60.

The low pressure recipient 60 may be reset to its initial state by providing a reset recipient connected to the low pressure recipient 60, as described in U.S. patent application Ser. No. 12/338,669, filed on Dec. 18, 2008, entitled "Rechargeable Subsea Force Generating Device and Method" to R. Gustafson, the entire disclosure of which is incorporated herein.

Another way to reset the low pressure recipient at its initial conditions is described in U.S. patent application Ser. No. 12/960,770, filed on Dec. 6, 2010, entitled "Rechargeable Subsea Force Generating Device and Method" to R. Gustafson, the entire disclosure of which is incorporated herein. Therein, it is described that a pump may be connected to the low pressure recipient to remove the seawater or other fluid and reestablish a low pressure of a gas inside the low pressure recipient.

The valve 62 may be a dual chamber valve 70 as illustrated in FIG. 4. The valve 70 may have various ports 70*a* to 70*e* to allow connecting other various components to the valve 70 (i.e., to block or allow a fluid communication between a connected component and a chamber of the valve). For example, a port 70*a* may be connected to the opening chamber 58, a port 70*b* may be connected to the low pressure recipient 60, and a port 70*c* may be connected to the controller 18 (where redundant yellow and blue PODs are typically located). A pressure higher than the hydrostatic pressure may be provided when a fluid communication is enabled between the opening chamber 58 and the controller 18, to provide a force opposite to the force provided when the low pressure recipient 60 is in fluid communication with the opening chamber 58. Thus, the BOP may be closed when the low pressure recipient 60 is in fluid communication with the opening chamber 58, and opened when the controller 18 is in fluid communication with the opening chamber 58. As understood by those of ordinary skill in the art, the closing of the BOPs must be swift (i.e., time and force are of the essence) to prevent damaging of the equipment due to "kicks", while the opening of the BOPs is less demanding. Thus, providing a higher pressure hydraulic fluid from the surface via the controller 18 may be employed to open the BOPs.

The valve 70 is actuated between the various states by a pilot 80, which can be a mechanic, hydraulic or electromechanic mechanism. Once the pilot supply is removed a spring 90 will shift the valve to its normal position. A double piloted valve could also be used to shift the valve from either position if an additional pilot signal was provided.

Cross-sections through a conventional sub plate mounted (SPM) valve 100 (used e.g. in the apparatus 30) are illustrated in FIGS. 5A and 5B. FIG. 6 is a blow-up representation of the parts of the conventional SPM valve 100. As illustrated in FIGS. 5A, 5B and 6, the conventional SPM valve 100 includes an upper seat 101, seals 102*a* and 102*b*, a rod seal 103, a backup plate 104, an outer spring 105, an inner spring 106, a spring retainer 107, a split collet 108, a pilot piston 109, a piston seal 110, a piston housing 111, a valve stem 112, a spool 113, a nut 114, a cage 115, a rod seal 116, a seal 117, a lower seat 118 and a valve body 119. The outer spring 105, inner spring 106, spring retainer 107, and split collet 108 are housed within a piston housing chamber 121, which is vented to sea pressure. The conventional SPM valve 100 has a port 130 that can serve to connect to the opening chamber 58, a port 135 that can serve to connect the low pressure vessel 60, and a port 140 that can serve to connect the controller 18. In FIG. 5A, the spool 113 is in a first position being located close to the upper seat 101. In FIG. 5B, the spool 113 is in a second position being located close to the lower seat 118.

This conventional SPM valve 100 is not suitable to be used in the apparatus 50 (i.e., to be connected to a low pressure recipient inside which the pressure may be as low as 1 atm) because it cannot withstand the high pressure difference between the chambers 150, port 135 and chamber 121 of the valve. The upper seat 101 and the backup plate 104 are located at an interface between these chambers. The upper seat 101, which is typically made of plastic is fully supported by backup plate 104 when the valve is exposed to internal pressure in its conventional operating condition. However, when the valve 100 is positioned so that port 130 is aligned with port 135 to align the opening chamber 58 to the low pressure vessel 60, the pressure differential between the seawater pressure in chamber 121 and the low pressure in chamber 150 is felt across upper seat 101. As a result, the plastic seat 101 may deform by bowing outward along valve stem 112 and be prone to damage because it is not fully supported inside port 135 and chamber 150. The plastic seat is used because it is slightly elastic and when the spool 113 comes in contact with the seat 130 the contact surface creates a seal between port 135 and chamber 150 when the spool 113 is engaged on the upper seat 101 and when the valve is operated the opposite contact face of the spool 113 contacts the lower seat 118 and the contact surface creates a seal between chambers 150 and port 140. Also, due to an increased pressure difference inside the valve, the potential of leaking fluid towards the lower pressure chamber foreseeable increases (for example, when a fluid communication between the low pressure recipient 60 and the chamber 150 is established), thereby damaging the valve and the apparatus.

Accordingly, it would be desirable to provide a valve capable to avoid these problems having a sealing system that would make the valve useable undersea, in an arrangement which generates force to operate the BOPs using a low pressure recipient.

SUMMARY

According to one exemplary embodiment, a valve useable in an undersea arrangement configured to generate force for closing a blowout preventer (BOP) based on a pressure difference between a low pressure recipient and ambient pressure is provided. The valve has a valve body enclosing a chamber with an input port selectively connectable to an output port, and a chamber separating assembly configured to separate the chamber from a region of different pressure. The assembly includes (1) a backup plate having a first portion of a first diameter towards the chamber and a second portion of a second diameter larger than the first diameter, towards the region, and (2) an upper seat located between the first portion of the backup plate and the valve body.

According to another exemplary embodiment, an apparatus for generating a force for closing a blowup preventer (BOP) undersea, the force being generated due to a pressure difference between a hydrostatic pressure and a low pressure, is provided. The apparatus includes a cylinder separated in two chambers by a piston connected to a rod configured to transmit the force generated due to a pressure imbalance between the two chambers, to the BOP. The apparatus further includes a low pressure recipient a valve configured to selectively enable a fluid communication between the low pressure recipient and one of the chambers of the cylinder. The valve has a valve body enclosing a chamber with an input port selectively connectable to an output port, and a separating assembly configured to separate the chamber from a region of different pressure. The assembly includes (1) a backup plate having a first portion of a first diameter towards the chamber and a second portion of a second diameter larger than the first diameter, towards the region, and (2) an upper seat located between the first portion of the backup plate and the valve body.

According to another exemplary embodiment a method of retrofitting a sub plate mounted (SPM) valve to become capable to withstand a big pressure difference between a low pressure inside the valve and a hydrostatic pressure outside thereof is provided. The method includes removing a chamber separating assembly configured to separate a chamber inside a valve body, from a region of different pressure. The method further includes mounting a new separating assembly configured to separate the chamber inside the valve body, from the region of different pressure. The new separating assembly includes (1) a backup plate having a first portion of a first diameter towards the chamber and a second portion of a second diameter larger than the first diameter, towards the region, and (2) an upper seat located between the first portion of the backup plate and the valve body.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of BOP systems. However, the embodiments to be discussed next are not limited to these systems, but may be applied to other systems that require a valve operating undersea and having to withstand a high pressure difference relative to a pressure lower than hydrostatic pressure.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

As understood by those of ordinary skill in the art, when a valve is used in a conventional apparatus generating a subsea force (i.e., due to a pressure difference between hydrostatic pressure and a pressure larger than the hydrostatic pressure), the pressure inside the valve may be at times larger than the hydrostatic pressure and hydraulic liquid may leak outside the valve. In contrast, when the valve is used in an apparatus generating a subsea force (due to a pressure difference between hydrostatic pressure and a pressure substantially smaller than the hydrostatic pressure), the pressure inside the valve may be at times substantially smaller (e.g., ~1 atm vs ~240 atm hydrostatic pressure at 2500 m depth) than the hydrostatic pressure and seawater may penetrate inside the valve, destroying the valve, and, even rendering the apparatus unable to close the BOPs. Taking into consideration these different circumstances valves according to various embodiments are configured to be efficiently and safely used in when the pressure inside the valve is substantially smaller than the hydrostatic pressure.

Figure 7A:
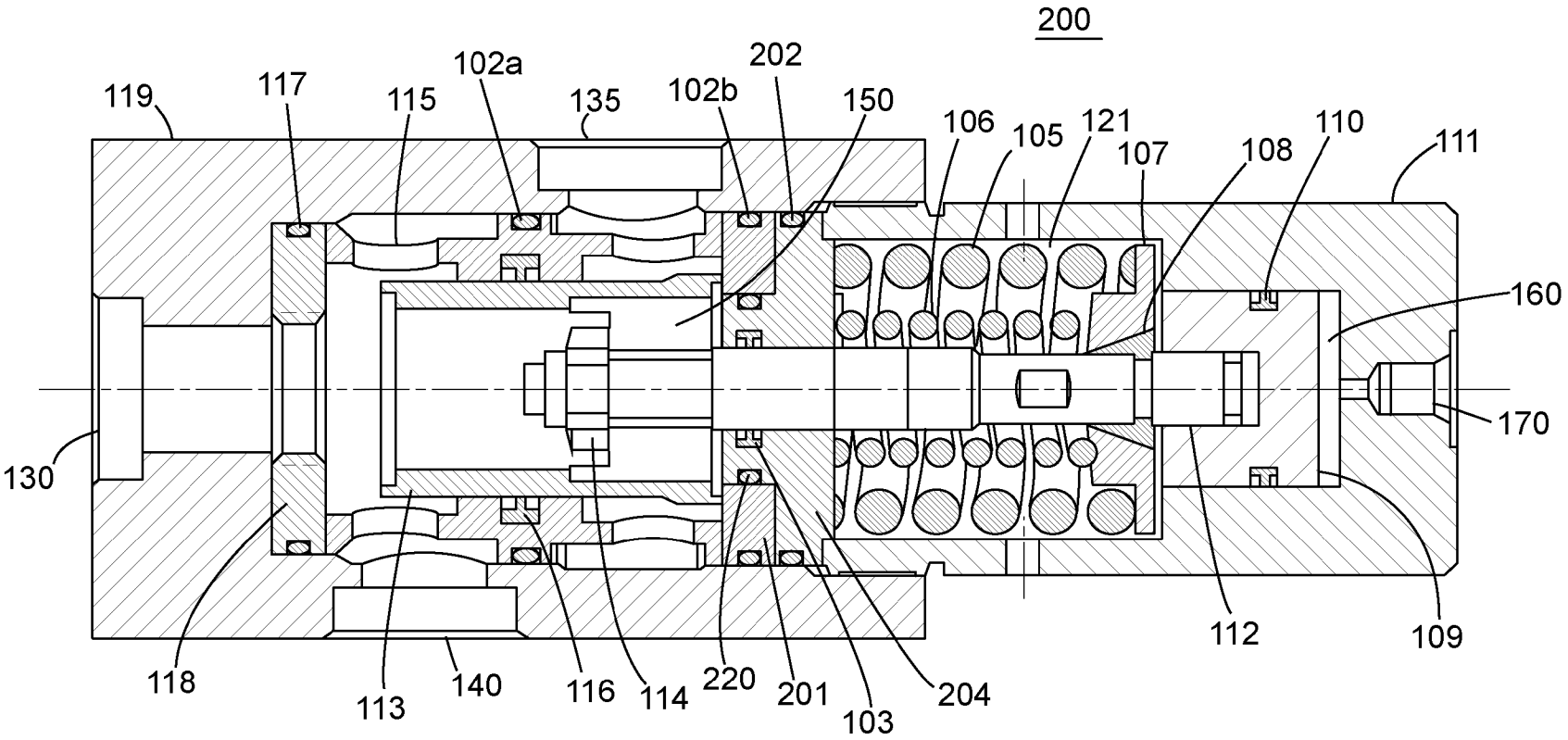
FIG. 7A is a cross-section through a SPM valve according to an exemplary embodiment, while a spool thereof is in a first position.
Figure 7B:
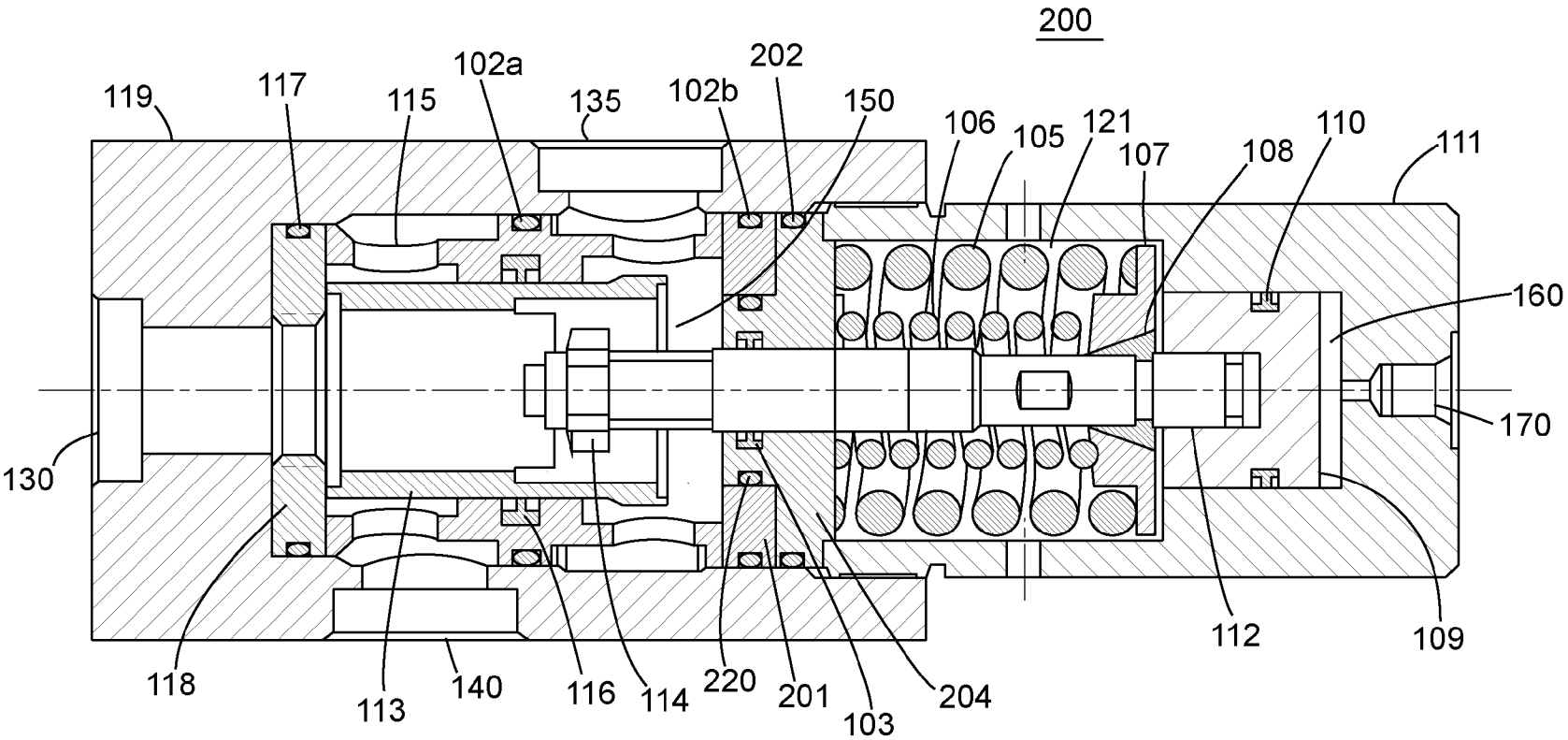
FIG. 7B is a cross-section through a SPM valve according to an exemplary embodiment, while a spool thereof is in a second position.
Figure 8:
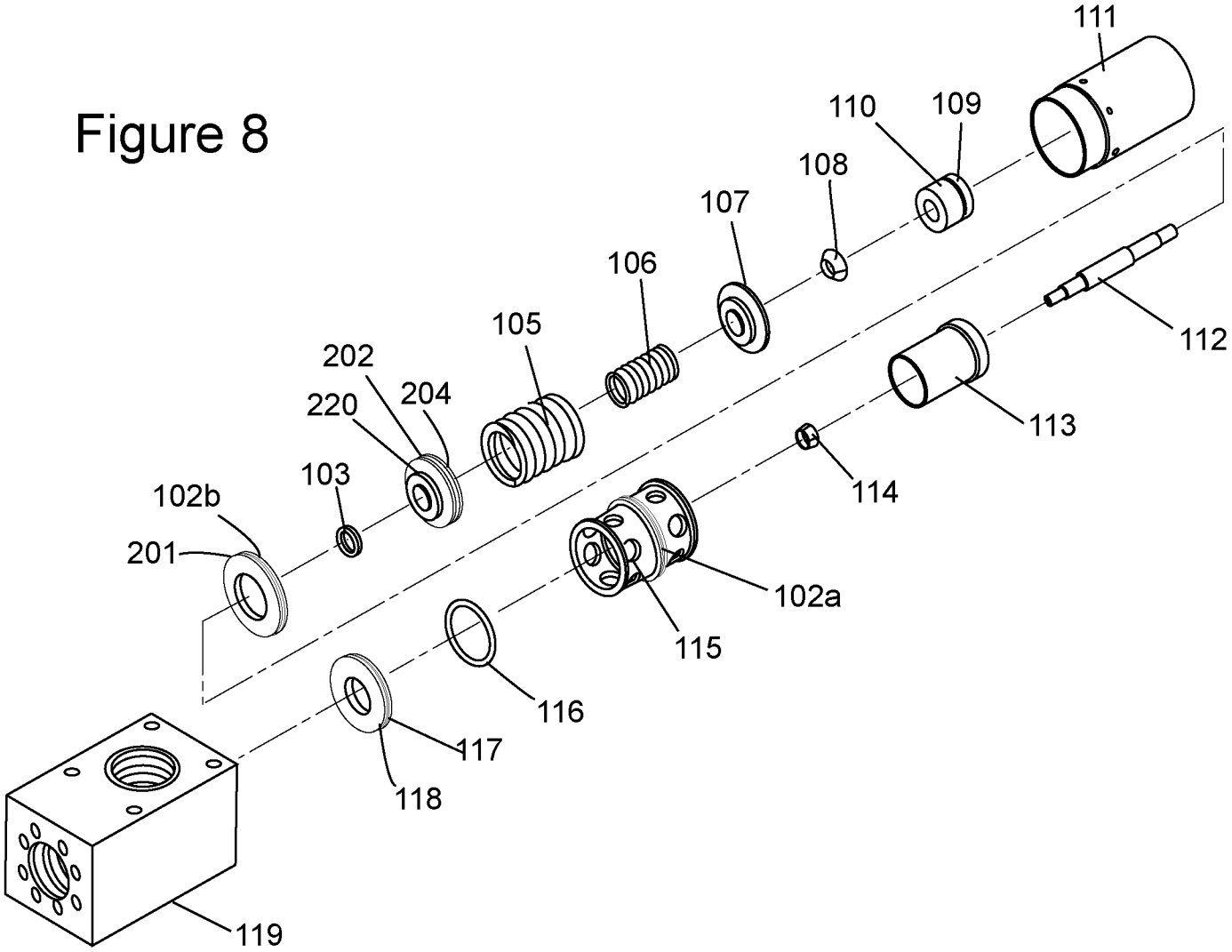
FIG. 8 is a blown-up representation of a SPM valve, according to an exemplary embodiment.

Cross-sections through a valve 200 according to an exemplary embodiment are illustrated in FIGS. 7A and 7B. The valve 200 is a modified version of the conventional SPM valve 100 in order to be used undersea and connected to a low pressure recipient inside which gas has a substantially lower pressure than the hydrostatic pressure. FIG. 8 is a blow-up representation of the parts of the valve 200. As illustrated in FIGS. 7A, 7B and 8, the valve 200 includes an upper seat 201, seals 102*a* and 102*b*, a seal 202, a rod seal 103, a backup plate 204, an outer spring 105, an inner spring 106, a spring retainer 107, a split collet 108, a pilot piston 109, a piston seal 110, a piston housing 111, a valve stem 112, a spool 113, a nut 114, a cage 115, a rod seal 116, a seal 117, a lower seat 118 and a valve body 119. In FIG. 7A, the spool 113 is in a first position being located close to the upper seat 201. In FIG. 7B, the spool 113 is in a second position being located close to the lower seat 118.

Figure 1:
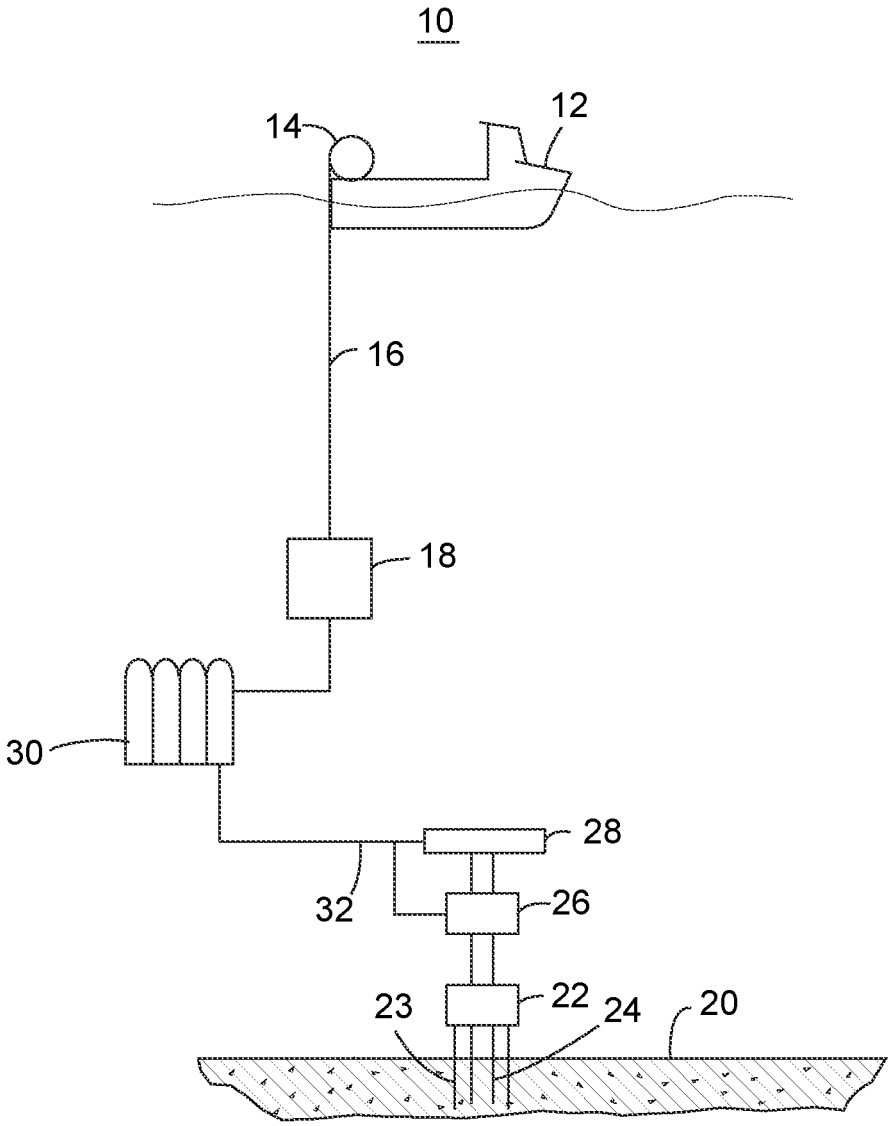
Figure 1 Background Art
FIG. 1 is a schematic diagram of a conventional offshore rig.
Figure 2:
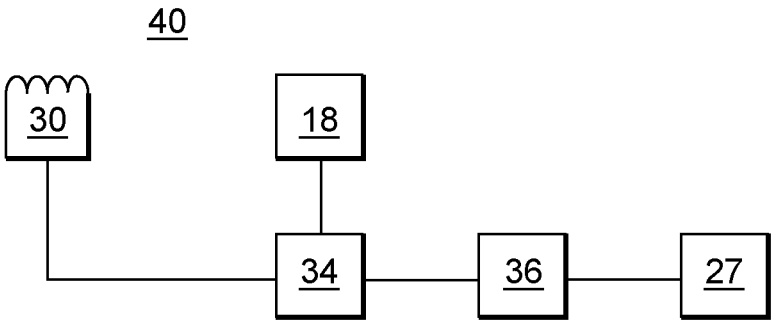
Figure 2 Background Art
FIG. 2 is a schematic diagram of an apparatus conventionally used for generating a force to actuate BOPs.
Figure 3:
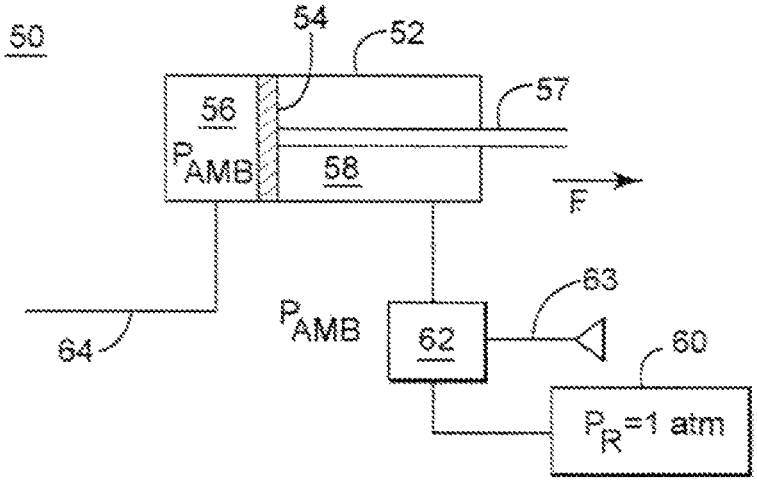
Figure 3 (Prior Art)
FIG. 3 is a schematic diagram of an apparatus using a low pressure recipient to generate force for actuating the BOPs.
Figure 4:
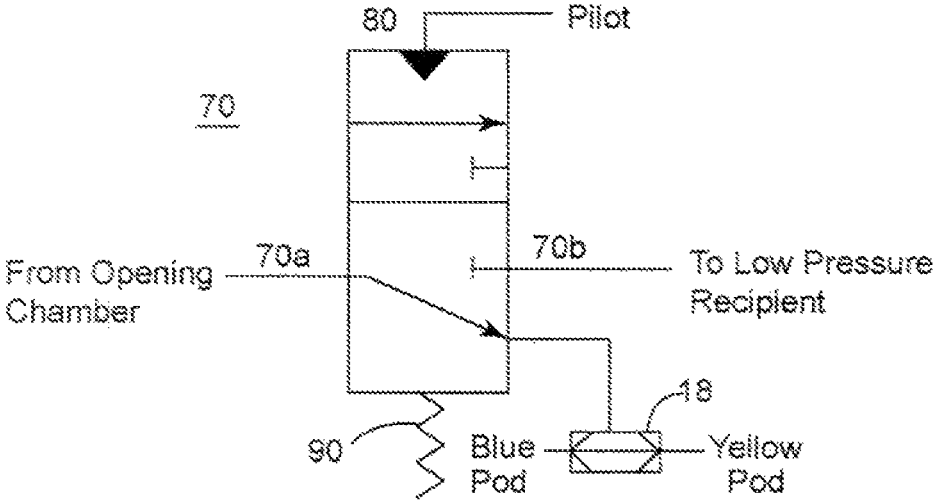
Figure 4 (Prior Art)
FIG. 4 is a schematic diagram of a dual chamber valve used in an apparatus for generating subsea a force for actuating the BOPs using a low pressure recipient.
Figure 5A:
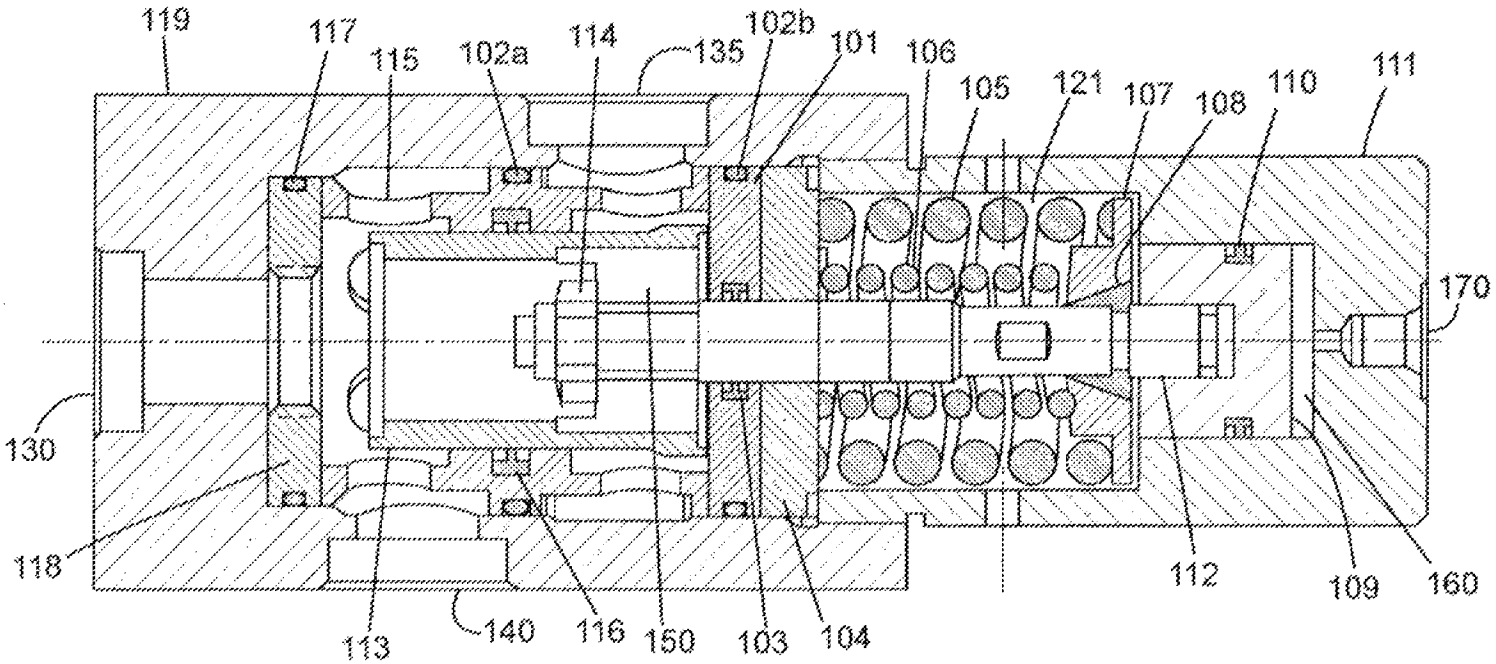
Figure 5A (Prior Art)
FIG. 5A is a cross-section through a conventional SPM valve while a spool thereof is in a first position.
Figure 5B:
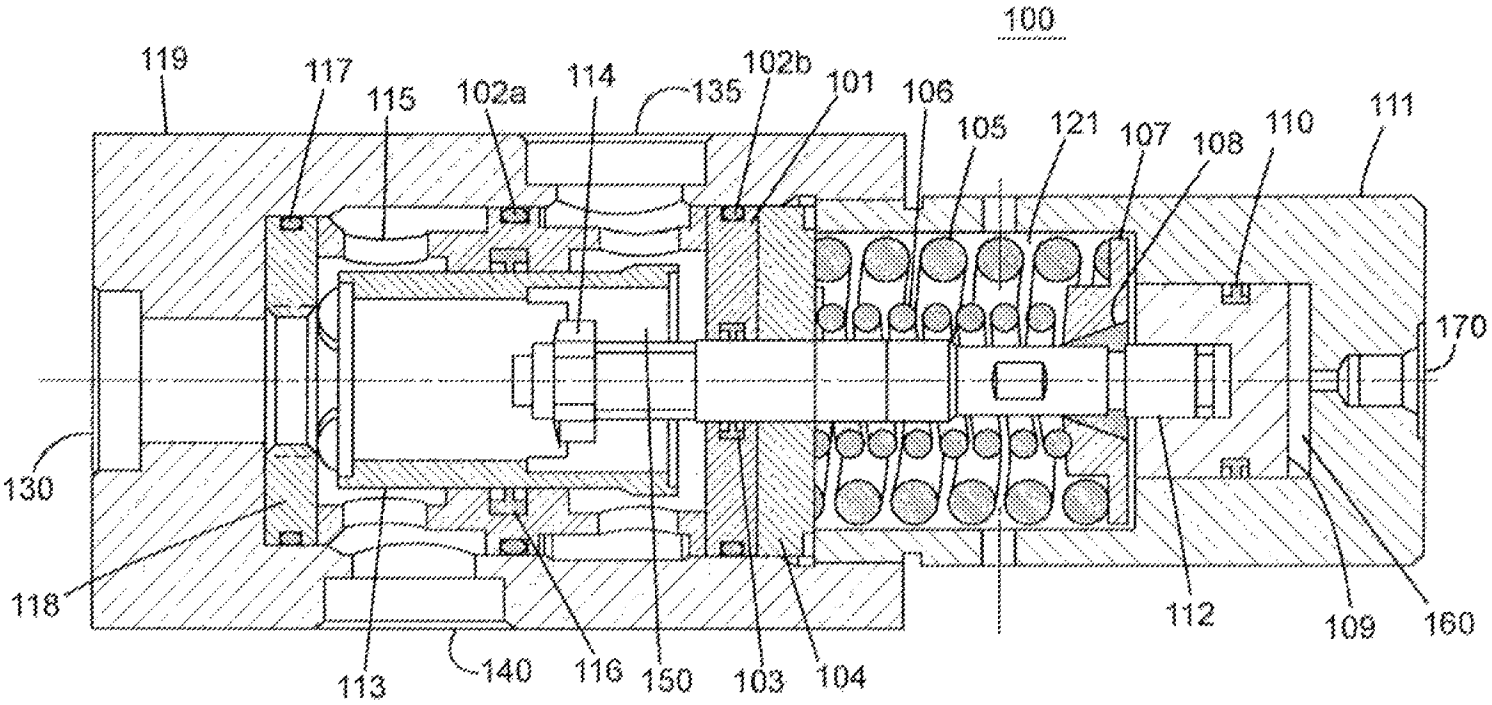
Figure 5B (Prior Art)
FIG. 5B is a cross-section through a conventional SPM valve while a spool thereof is in a second position.
Figure 6:
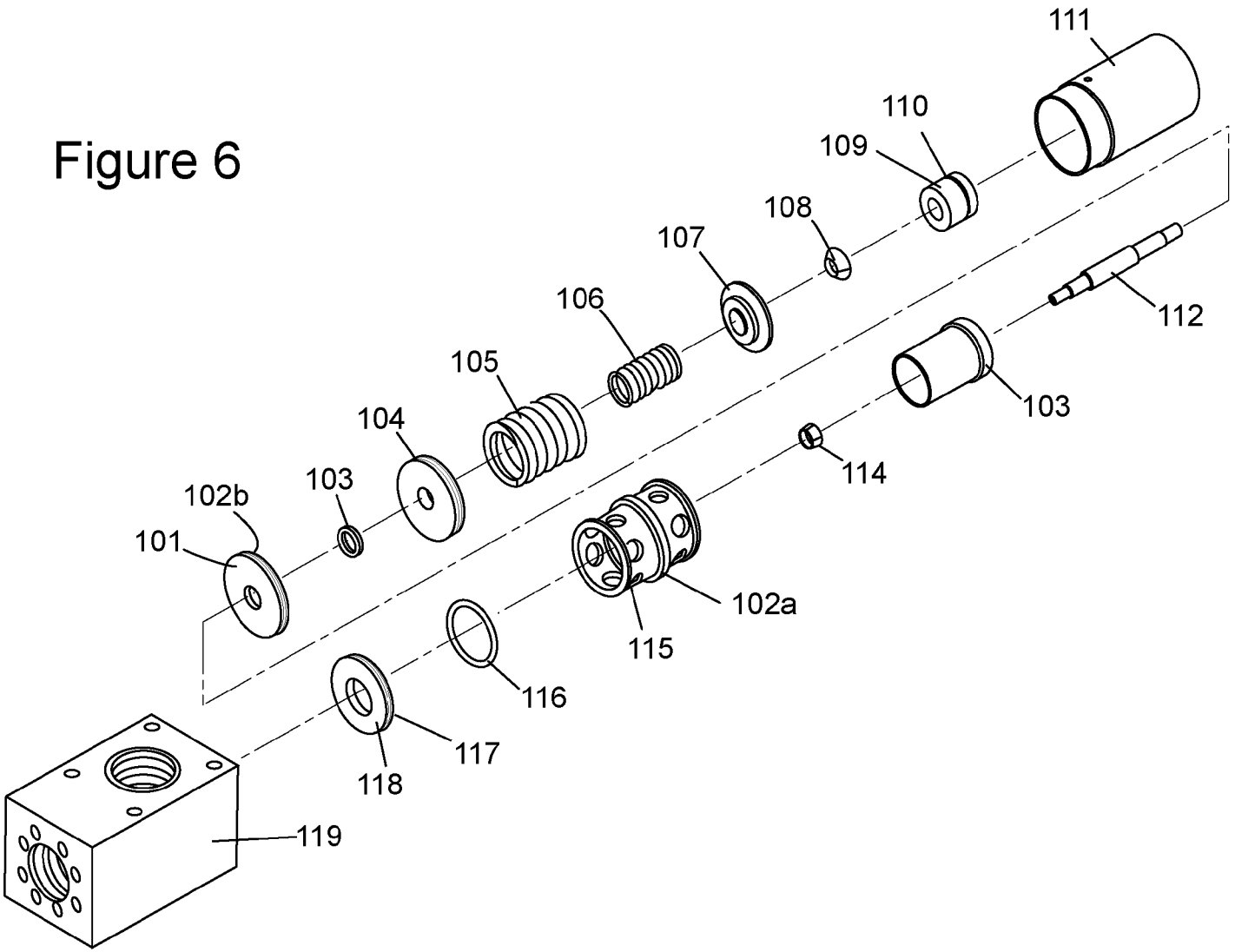
FIG. 6 is a blown-up representation of a conventional SPM valve.

Thus, besides parts similar to parts in a conventional SPM valve (similar parts having the same label as in FIGS. 5 and 6), the valve 200 has an additional seal 220 located between the upper seat 201 and the back-up plate 204, and an additional seal 202 located between the backup plate 204 and the valve body 119.

The back-up plate 104 being essentially a disk with a central hole through which the valve stem 112 passes when the valve is assembled. Different from the back-up plate 104 of the conventional SPM valve 100, the back-up plate 204 of the valve 200 has two portions, a first diameter of the first portion being smaller than a second diameter of the second portion. The back-up plate 204 also has a central hole through which the valve stem 112 passes when the valve is assembled.

The upper seat 101 of the conventional SPM valve has a central hole through which the valve stem 112 passes when the valve is assembled. Different from the upper seat 101, the upper seat 201 has a larger hole being configured to surround the first portion of the backup plate 204. The upper seat 201 has an inner diameter substantially equal to the first diameter of the back-up plate 204, and an outer diameter substantially equal to the second diameter of the back-up plate 204. The upper seat 201 and the back-up plate 204 may have essentially the same total volume as the upper seat 101 and the back-up plate 104.

The valve body 119 encloses a chamber 150 with a port 130 that can serve to connect to the opening chamber, a port 135 that can serve to connect the low pressure vessel and a port 140 that can serve to connect a controller. Since the port 130 is used to transfer a pressure different from an initial pressure to the opening chamber, the port 130 may be considered an output port. The pressure is transferred through the valve from a low pressure recipient or from a controller via ports 135 and 140 selectively opened towards the chamber 150. Thus, the ports 135 and 140 can be considered to be input ports, being the source of changing the pressure to generate force for operating the BOP.

Due to the redesigned shapes of the upper seat 201 and the backup plate 204, the valve 200 operates more reliable than a conventional SPM valve undersea, when the valve is connected to a low pressure recipient, and, therefore, must withstand large external pressure differences. The additional seals 220, 202, provide a method to prevent seawater external pressure from chamber 121 reacting on the back side of the plastic upper seat 201 and damaging it when the ambient pressure inside chamber 150 on the front side of upper seat 201 is lower than the surrounding pressure external. Therefore, upper seat 201 does not experience the differential pressure between seawater pressure and the lower pressure in the low pressure recipient 60 via chamber 150. As a result, there is no force to cause upper seat 201 to bow or deform. The valve 200 may operate for pressure differences (between the hydrostatic pressure and the pressure in the low pressure recipient) and still function with the same sealing arrangement as the spool 113 engages onto the upper seat 201.

Figure 9:
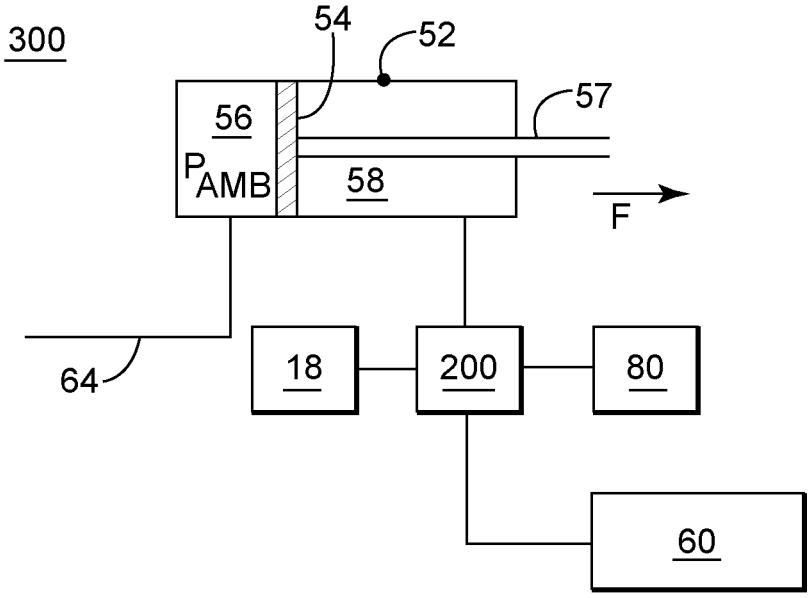
FIG. 9 is an apparatus using a low pressure recipient to generate force for actuating the BOPs according to an exemplary embodiment.

FIG. 9 is a schematic diagram of an apparatus 300 for generating subsea a force based on a pressure difference between the hydrostatic pressure and a low pressure, according to an exemplary embodiment. The apparatus 300 includes an enclosure 52 having inside a piston 54 configured to move along thereof. The piston 54 divides the enclosure 52 into a closing chamber 56 and an opening chamber 58. A pressure difference between the opening chamber 58 and the closing chamber 56 yields an actuation force moving the piston 54. The opening chamber 58 is selectively connected to a low pressure recipient 60 and a controller 18 via a valve 200. A pilot 80 may actuate the valve 200.

Figure 10:
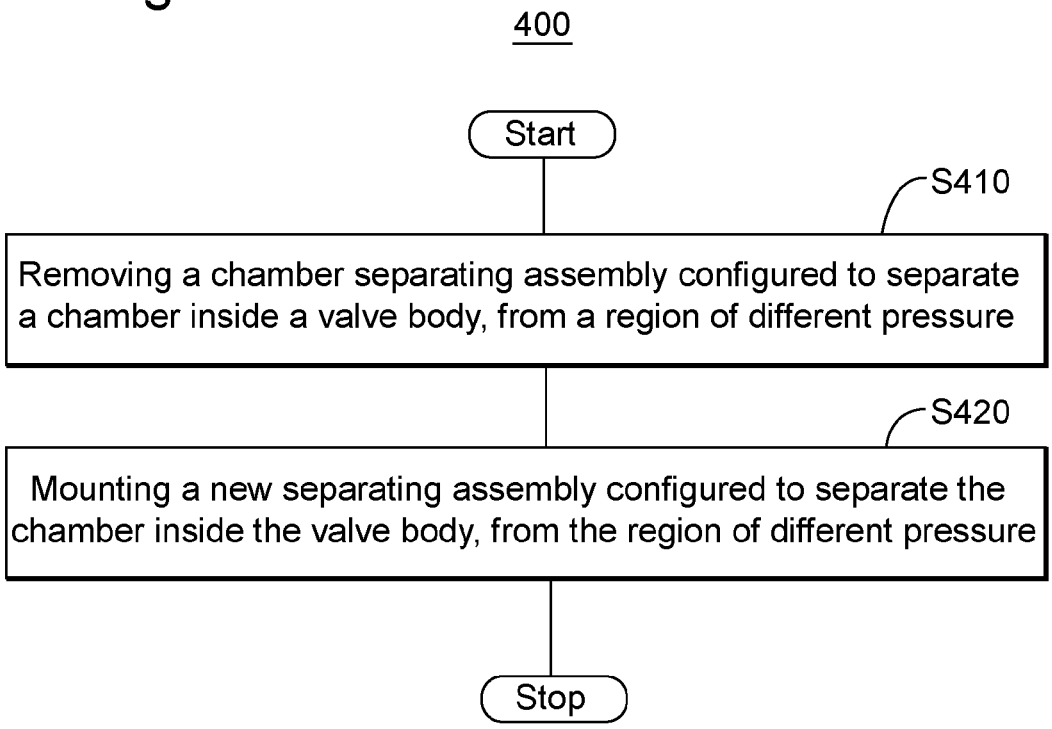
FIG. 10 is a flow chart illustrating a method for retrofitting a conventional SPM valve, according to an exemplary embodiment.

A conventional SPM valve (such as 100 in FIGS. 5 and 6) may be retrofitted to become a valve similar to the valve 200. A flow diagram of a method 400 for retrofitting a conventional valve is illustrated in FIG. 10. The method 400 includes removing a chamber separating assembly (e.g., the upper seat 101, and the back-up plate 104) configured to separate a chamber (e.g., 150) inside a valve body (e.g., 119), from a region of different pressure, at S410. The method 400 further includes, mounting a new separating assembly (e.g., the upper seat 201, and the back-up plate 204) configured to separate the chamber (e.g., 150) inside the valve body (e.g., 119), from the region of different pressure. The new separating assembly includes a back-up plate (e.g., 204) and an upper seat (e.g., 201). The backup plate (e.g., 204) has a first portion of a first diameter towards the chamber (e.g., 150) and a second portion of a second diameter larger than the first diameter, towards the region. The upper seat (e.g., 201) is located between the first portion of the backup plate (e.g., 204) and the valve body (e.g., 119).

The method 400 may further include mounting a first additional seal (e.g., 220) located between the upper seat and the backup plate. The method 400 may also include mounting a second additional seal (e.g., 202) between the backup plate and the valve body. The volume of the new chamber separating assembly may be substantially equal to a volume of the chamber separating assembly that is removed. The back-up plate may be made of metal and the upper seat may be made of plastic or pliable material.

The disclosed exemplary embodiments provide a valve and a method of retrofitting a valve to be used in an arrangement for generating a force undersea with a reduced consumption of energy and at a low cost. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A valve useable in an undersea arrangement configured to generate force for closing a blowout preventer (BOP) based on a pressure difference between a low pressure recipient and ambient pressure, the valve comprising:

a valve body enclosing a chamber with an input port selectively connectable to an output port; and a chamber separating assembly that defines a pressure barrier between the chamber and a region of different pressure, the assembly including:

a backup plate having a first portion disposed adjacent the chamber and a second portion having a diameter larger than a diameter of the first portion and that is disposed adjacent the region and on a side distal from the chamber; and an annual upper seat circumscribing the first portion of the backup plate and circumscribed by the valve body.

2. The valve of claim 1, further comprising a first seal and a first additional seal located between the upper seat and the backup plate and a second seal and a second additional seal between the backup plate and the valve body.

3. The valve of claim 1, wherein the input port is connected to a low pressure recipient storing fluid at a low pressure substantially smaller than an ambient pressure outside the chamber.

4. The valve of claim 3, wherein the low pressure is about 1 atm.

5. The valve of claim 1, wherein the backup plate is made of metallic material.

6. The valve of claim 1, wherein the upper seat is made of a plastic or pliable material.

7. An apparatus for generating a force for closing a blowup preventer (BOP) undersea, the force being generated due to a pressure difference between a hydrostatic pressure and a low pressure, the apparatus comprising:

a cylinder separated in two chambers by a piston connected to a rod configured to transmit the force generated due to a pressure imbalance between the two chambers, to the BOP;

a low pressure recipient; and a valve configured to selectively enable a fluid communication between the low pressure recipient and one of the chambers of the cylinder, the valve having a valve body enclosing a chamber with an input port selectively connectable to an output port; and a separating assembly configured to separate the chamber from a region of different pressure, the assembly including:

a backup plate having a first portion facing the chamber and a second portion having a diameter larger than a diameter of the first portion, and facing towards the region; and an annular upper seat circumscribing the first portion of the backup plate and circumscribed by the valve body.

8. The apparatus of claim 7, further comprising a first seal and a first additional seal located between the upper seat and the backup plate and a second seal and a second additional seal between the backup plate and the valve body.

9. The apparatus of claim 7, wherein the input port is connected to a low pressure recipient storing fluid at a low pressure substantially smaller than an ambient pressure outside the chamber.

10. The apparatus of claim 9, wherein the low pressure is about 1 atm.

11. The apparatus of claim 7, wherein the backup plate is made of metallic material.

12. The apparatus of claim 7, wherein the upper seat is made of a plastic or pliable material.

* * * * *